United States Patent [19]

Blosser

[11] Patent Number: 4,596,384

[45] Date of Patent: Jun. 24, 1986

[54] SPINAL ADJUSTMENT TABLE

[76] Inventor: Edward E. Blosser, P.O. Box 201, Scio, Ohio 43988

[21] Appl. No.: 232,398

[22] Filed: Feb. 9, 1981

Related U.S. Application Data

[63] Continuation-in-part of Ser. No. 84,672, Oct. 15, 1979, abandoned.

[51] Int. Cl.[4] ..... A47G 9/00

[52] U.S. Cl. ..... 269/322; 5/465

[58] Field of Search ..... 269/322–328, 269/70, 279, 284; 128/69, 70; 5/462, 464, 465; 211/70, 78, 95, 131, 163, 164; 29/33 J, 35.5, 44, 50; 22/36 A; 52/64, 65; 46/24–26, 27–29, 16–17

[56] References Cited

U.S. PATENT DOCUMENTS

| | | | |
|---|---|---|---|
| 1,548,728 | 8/1925 | Milam | 5/462 |
| 2,089,854 | 8/1937 | Pellegrini | 5/462 |
| 2,182,861 | 12/1939 | Albert | 5/462 |
| 2,475,003 | 7/1949 | Black | 269/322 |
| 3,118,152 | 1/1964 | Talley | 5/462 |
| 3,428,974 | 2/1969 | Stuart | 5/464 |
| 3,603,026 | 9/1971 | Kishigami | 46/26 |
| 3,672,681 | 6/1972 | Wolf | 46/26 |
| 3,967,335 | 7/1976 | Rhoads | 5/462 |
| 3,988,793 | 11/1976 | Abitbol | 5/462 |
| 4,054,960 | 10/1977 | Pettit et al. | 5/462 |

FOREIGN PATENT DOCUMENTS

| | | | |
|---|---|---|---|
| 2922443 | 11/1980 | Fed. Rep. of Germany | 5/462 |

*Primary Examiner*—Robert C. Watson

*Attorney, Agent, or Firm*—William P. Hickey

[57] ABSTRACT

The invention relates to a table specifically constructed and designed for use in the practice of osteopathy. Particularly, the table includes separate support surfaces for the head, chest-abdomen and hip areas wherein the spring rate for the chest-abdomen support surface is considerably less than the spring rate for the generally unyielding head and hip support surfaces. The chest-abdomen support surface also has breast receiving openings to facilitate altering the curvature of the dorsal spinal region without putting appreciable pressure on the breasts. More particularly the breast receiving openings should be spaced approximately three inches from the head end of the chest-abdomen support surface, and the chest-abdomen support surface should be constructed and arranged so that downward force thereon sufficient to move one vertebra relative to another will move the chest-abdomen support surface below the head and hip support surfaces by at least approximately two inches.

9 Claims, 7 Drawing Figures

SPINAL ADJUSTMENT TABLE

The present application is a continuation-in-part of my copending application Ser. No. 84,672 filed Oct. 15, 1979, now abandoned.

TECHNICAL FIELD

The present invention relates to tables for supporting the human body in a prone position; and more particularly to spine adjustment tables.

BACKGROUND OF THE INVENTION

During the physical realignment of the vertebrae of the human body, the patient most frequently is laid horizontally facing downwardly on a table. The alignment of the vertebrae is fealt and/or observed by the doctor, and at times the doctor concentrates a downward force on one of the vertebra to push it downwardly relative to the adjacent vertebrae. This downward force is exerted through the body and requires either a distortion of the body, or the table, or both to accomodate the necessary spinal deflection.

According to the present invention, it is recognized that downward deflection of the spine in the chest area of females produces undersirable and sometimes painful stretching of the soft breast tissues when the chest is supported on a flat surface.

It is therefore an object of the present invention to provide a spine adjustment table which will properly support the spine while allowing a short section thereof to be deflected inwardly in the chest area without stretching breast tissue.

A further object of the invention is the provision of a table of the above described type which is easily adjustable to properly support humans having a considerable difference in the overall length of the body.

Further objects of the invention will be apparent to those skilled in the art to which the invention relates from the following description of the preferred embodiments described with reference to the accompanying drawings forming a part of this specification.

DESCRIPTION OF THE PREFERRED EMBODIMENTS

Figure 1:
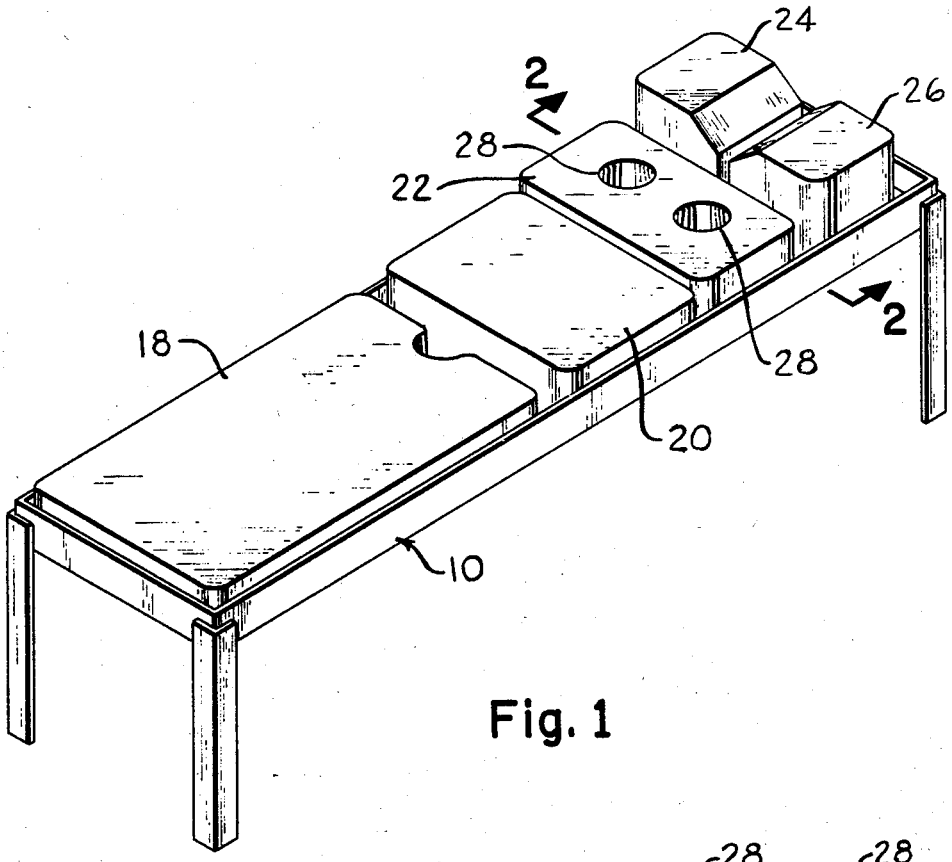
FIG. 1 is an oblique view of an adjustment table for the human spine, and which embodies principles of the present invention.

The human breasts are located over the fourth, fifth and six ribs between the sternum and the axilla. Each of these ribs are connected between the vertebra and the sternum, with the connection to the sternum being made by cartilage which provides a type of hinging action. When a downward force is being applied to one or more vertebrae, it is necessary that the downward forces not be resisted by muscular action.

It is difficult or impossible to get a patient to relax an individual muscle in a particular part of the body; and in order that muscular resistance will be avoided in a particular area, it is necessary that all back and chest muscles be relaxed. This total relaxation is only achieved therefore if none of the muscles involved are required to be under tension to support the body over voids in the table on which the body is laying.

The spine generally is regarded as having three sections: namely the cervical, dorsal and lumbar regions. The cervical region extends from the head to the chest and is concave as viewed from the back. The dorsal region is convex and extends over the chest and abdomen, and the lumbar region is concave and extends generally over the hips to the sacrum. Between adjacent vertabra is a disc of elastic or cartilaginous tissue that permits some relative lateral movement between the adjacent vertebrae. A chiropractor or osteopath may press downwardly on the back of a person to move a particular vertebra that is misaligned upwardly from the adjacent vertebrae. In the dorsal region, the vertebrae are convex upwardly so that the natural arch of the back tends to key the vertebrae together. It is highly desirable, therefore, to sway the dorsal region into a concave position to open up the distance between the vertebrae before correcting their alignment. It is also desirable that the muscles and ligaments holding the vertebrae together should be as relaxed as possible during the adjustment. This necessitates that all muscles in the back be relaxed; and to accomplish this, the body should be supported so that the back muscles are not tensed to bridge the body between body support surfaces.

To take the load off of the back muscles and still permit the spinal column to be sagged concavely, the head and hips should be supported quite firmly, while the chest and abdomen are supported by a surface which resists body weight with a much lower spring rate. Preferably, the support surface for the chest and abdomen will carry the weight of the body before the spinal column is sagged, so that it is completely relaxed before the doctor presses downwardly. The doctor must be able to sag the back by over approximately two inches without exerting undue force; and this requires a chest and abdomen support surface which moves downwardly by that distance with a relatively low spring rate. In some instances it will be desirable that the back be bridged between the chest area above the breasts and the hips, rather than between the head and hips. It will also be seen that in the case of women, the back can be sagged much more efficiently if their body is not supported on their breasts.

According to the present invention, opening means for receiving the breasts are provided in a chest support surface having a low spring rate. This allows the back to be sagged more efficiently; it decreases the load placed upon the fourth through sixth ribs; it decreases discomfort and pressure on the breasts; and it may reduce or eliminate damage to the breasts and fourth through sixth ribs.

Preferably, the breast receiving opening means will comprise two individual openings which are spaced from the upper edge of the chest support surface by a distance corresponding generally to that of the width of the human first, second and third ribs (about three inches). Also the chest support surface should be such that the lower portion below the breasts will move downwardly by a greater distance than does the area over the first, second and third ribs, when downward pressure is applied to the dorsal region of the spinal column. Chiropractors and osteopaths do not think in terms of support surfaces; and the above mentioned principles have escaped them over the great number of years that these professions have been practiced.

Figure 2:
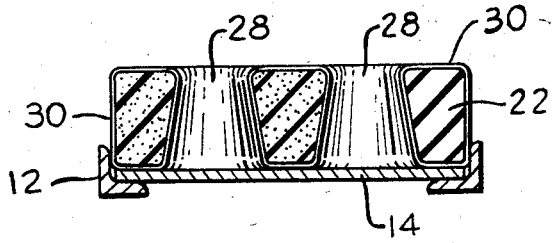
FIG. 2 is a cross-sectional view taken approximately on the line 2—2 of FIG. 1.

The table support surface is preferably sufficiently resilient that local areas beneath several adjacent ribs may be depressed beneath that of the remaining support surface; and in the embodiment shown in FIGS. 1 and 2 of the drawings, the table is surfaced with a plurality of resilient adjustable cushions with the one beneath the chest area containing individual pockets for the respective breasts.

The table of FIGS. 1 and 2 generally comprises a rectangular frame 10 having a peripheral upstanding edge 12. The frame can be made in any suitable manner, and as shown is made from structural aluminum angle welded together with one leg upstanding. A plywood deck 14 is fitted between the upstanding edge 12 leaving a portion of the edge 12 projecting vertically thereof. Suitable legs 16 are provided to support the deck 14 at slightly below conventional table height. The body support surface is provided by five cushions 18 through 26, respectively, that rest upon the deck 14 and are confined by the edge 12. The leg and hip cushion 18 may be fixed adjacent one end of the frame 10, but the remaining cushions are preferably movable lengthwise of the frame by a slight amount to accomodate different size people. Accordingly, there preferrably is clearance between the head cushions 24 and 26 and the adjacent end of the frame 10. The head cushions 24 and 26 may be made as a single cushion, but are shown as two separate cushions to better accomodate the nose and facilitate breathing. The chest cushion 22 is provided with two conically shaped openings 28 extending therethrough. The chest cushion 22 has sufficient length to provide several inches on either side of the openings 28 to yieldably support the first through third ribs on one side thereof, and the seventh rib on the opposite side thereof. The space between the openings 28 yieldably supports the sternum and cartilage connections with the third through sixth ribs. It will be seen that the cushion 22 is slidable lengthwise of the frame so that it can be positioned to support the ribs in the above described manner regardless of the height of the individual. The stomach cushion 20 has a length to support the area below the seventh rib down to the area above the hip bones. The hips of an individual are to be supported by the leg cushion 18.

The stomach cushion 20 is preferably kept close to the breast cushion 22, and the space between it and the leg and hip cushion 18 is varied to accomodate torsos of various lengths. The cushions can be made in any suitable manner, and in the embodiment shown, are made of a closed cell elastomeric foam covered by a suitably upholstery material. In the case of the breast cushion 22, it preferably contains a band 30, that is either part of the upholstery or is a separate piece beneath the upholstery, to distribute load around the openings 28 and across the cushion. For this purpose the outer ends of the band 30 are preferably anchored to the outer edges of the foam, and in the embodiment shown extend down the sides of the cushion. The band, therefore, acts as a sling to support the chest area. By using conically shaped openings through the breast cushion, it is possible to reverse the cushion to accomodate people having different sized breasts. The construction of the breast and stomach cushions 20 and 22 is such that they are more resilient and have a lower spring rate than do the head and leg cushions 18, 24 and 26.

Figure 3:
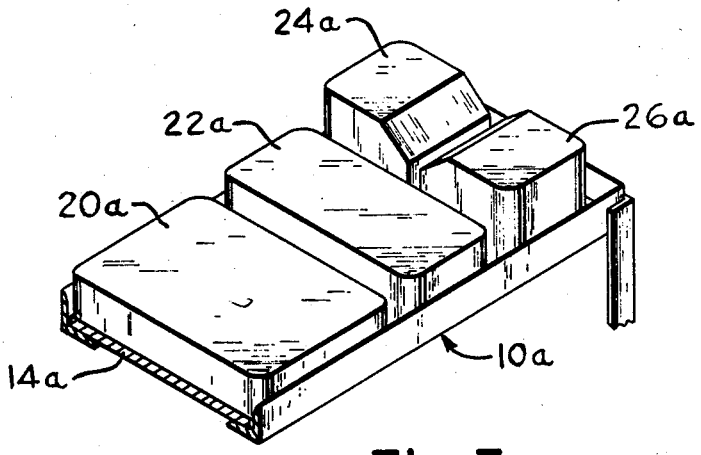
FIG. 3 is a fragmentary oblique view, similar to FIG. 1, but showing another embodiment of the invention.

The embodiment shown in FIGS. 3 is generally similar to the embodiment shown in FIGS. 1 and 2 excepting that the depression for receiving the breasts is formed by suitably spacing the breast and stomach cushions apart. Those partions of the embodiment shown in FIG. 3 which correspond to similar portions of the embodiment shown in FIGS. 1 and 2 are designated by a like reference numeral characterized further in that a suffix "a" is affixed thereto. When using this embodiment, the body is positioned so that the breasts project over the edge of the stomach cushion **20*a* with the seventh rib overlying the stomach cushion 20*a*. The breast cushion 22*a* is positioned beneath the first, second and third ribs, so that the upper portion of the sternum is yieldably supported by the breast cushion 22*a* and the lower portion of the sternum is supported by the stomach cushion 20*a***. The sternum, or breast bone, in this manner gives yieldable support to the third through sixth ribs.

Figure 4:
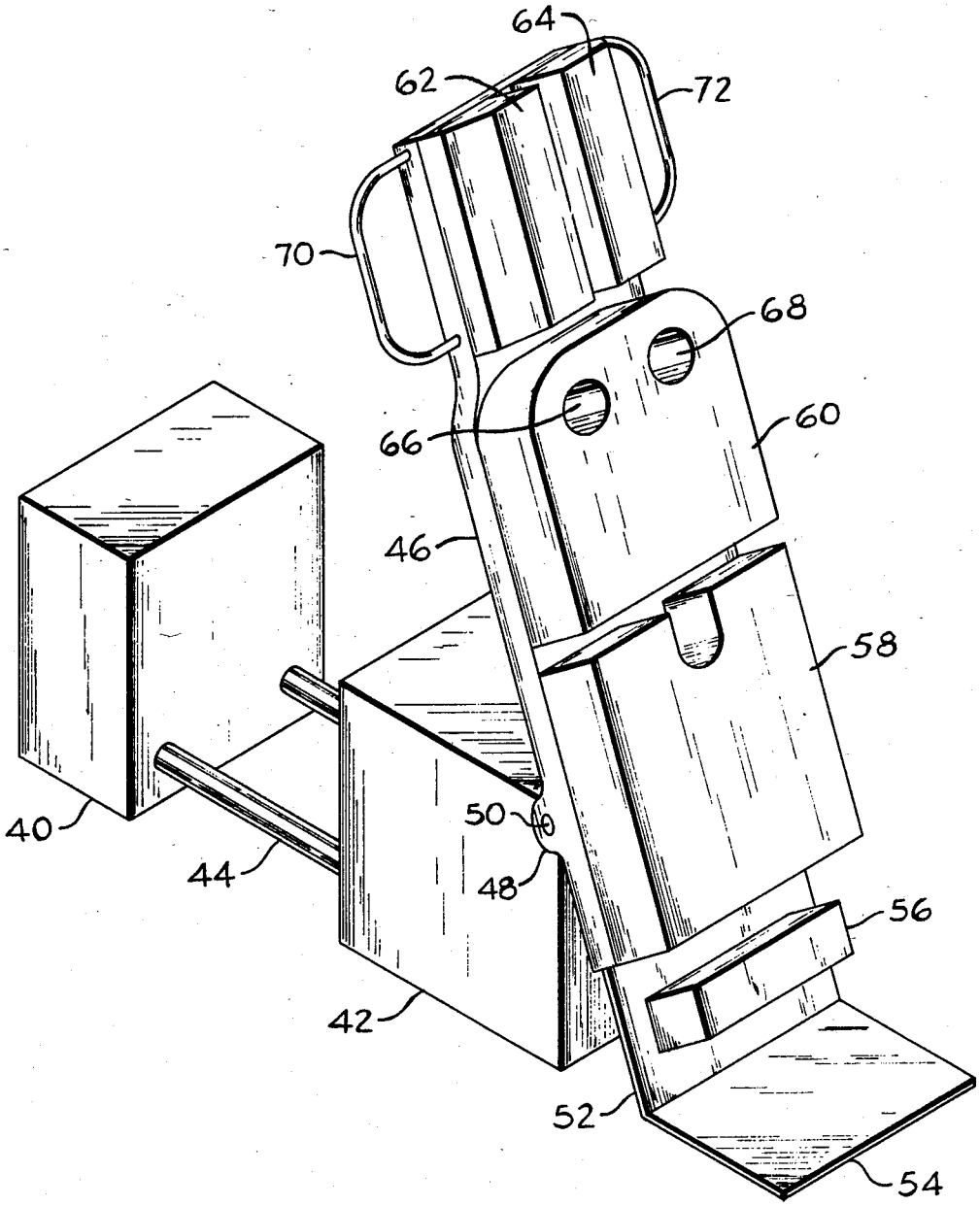
FIG. 4 is an oblique view of a tiltable table which embodies principles of the present invention.

The embodiment shown in FIG. 4 comprises a so called "sled", or tiltable table, adapted to receive the body in standing position and bring it down slowly to a prone position; so that the spine will be in the same position as occurs when the person is standing. The tiltable table shown, comprises a base formed by front and rear pedestals, 40 and 42, respectively which are connected together by a pair of tubes 44. The tiltable portion comprises a frame 46 that has depending ears 48 at about the lower quarter point which receives a horizontal hinge pin 50 that runs through, and is supported by, the rear pedestal 42. The frame 46 has a foot extension 52 which extends longitudinally of the frame and then obliquely as at 54, so that it is horizontal when the frame 46 is inclined at an angle of approximately 50 degrees. The extension 52 supports an ankle cushion 56 a short distance above the oblique extension 54, and a leg cushion 58 is fastened to the frame 46 upwardly thereof.

The opposite end of the leg cushion 58 is positioned adjacent the pelvis and is notched out to receive the pubic area. A combination stomach and chest cushion 60 is located forwardly of the leg cushion 58 and is of sufficient length that its upper end is opposite the neck of all but the most unusually tall persons. A pair of face cushions 62 and 64 are mounted on the frame forwardly of the stomach and chest cushion 60. The face cushions 62 and 64 are spaced apart to receive a nose and accomodate breathing as in the previously described embodiment. In the embodiment shown in FIG. 4, two breast receiving openings 66 and 68 of elliptical cross-section are spaced from the upper edge of the cushion 60 by a distance corresponding to the width of approximately three ribs so that the first, second and third ribs will overlie the cushion 60. The openings 66 and 68 are spaced apart to leave an area for the support of the sternum, and the openings are elliptically shaped to reasonably accomodate the largest of breasts.

In the sled shown in FIG. 4 the head cushions 62 and 64 are fairly firm as is the leg cushion 58. The stomach and chest cushion 60 however, is supported by spring means not shown which permits it to be pushed downwardly by two or more inches after it has taken the weight of the person lying on it. In addition, the surface of the stomach and chest cushion 60 is tiltable so that one end thereof can be deflected beneath the other end thereof. For example pressure over the breasts may move the head end of the cushion deeper into the sled than does the end adjacent the leg cushion, and vice versa.

The tiltable table is used by standing on the oblique extension 54, by grasping the handles 70 and 72, and by having someone lower the table down onto the pedestals 40 and 42. The face is supported on the cushions 62 and 64 with the nose therebetween. The breasts of course will be positioned in the respective openings 66 and 68. The doctor can then determine any misalignment of the spine, and can pressure vertebrae that are too far posterior, downwardly into alignment with adjacent vertebrae. In the area over the breasts, the vertabrae are yeldably supported by their ribs, which in turn extend around to the portion of the cushion between the openings 66 and 68 to give yieldable support thereto. Downward force concentrated on the vertebrae will require a minimum of relative flexture of the ribs and connecting cartilage. Since the vertebra that needs to be pushed anteriorly is initially in a position posteriorly of the adjacent vertebrae, resistance on it is less than on the adjacent vertebrae until it has been pushed down into alignment. Once alignment is achieved, support for the vertebra being pushed downwardly will increase to correspond with that on the adjacent vertebrae, and thus a mechanism is provided preventing over adjustment.

Figure 5:
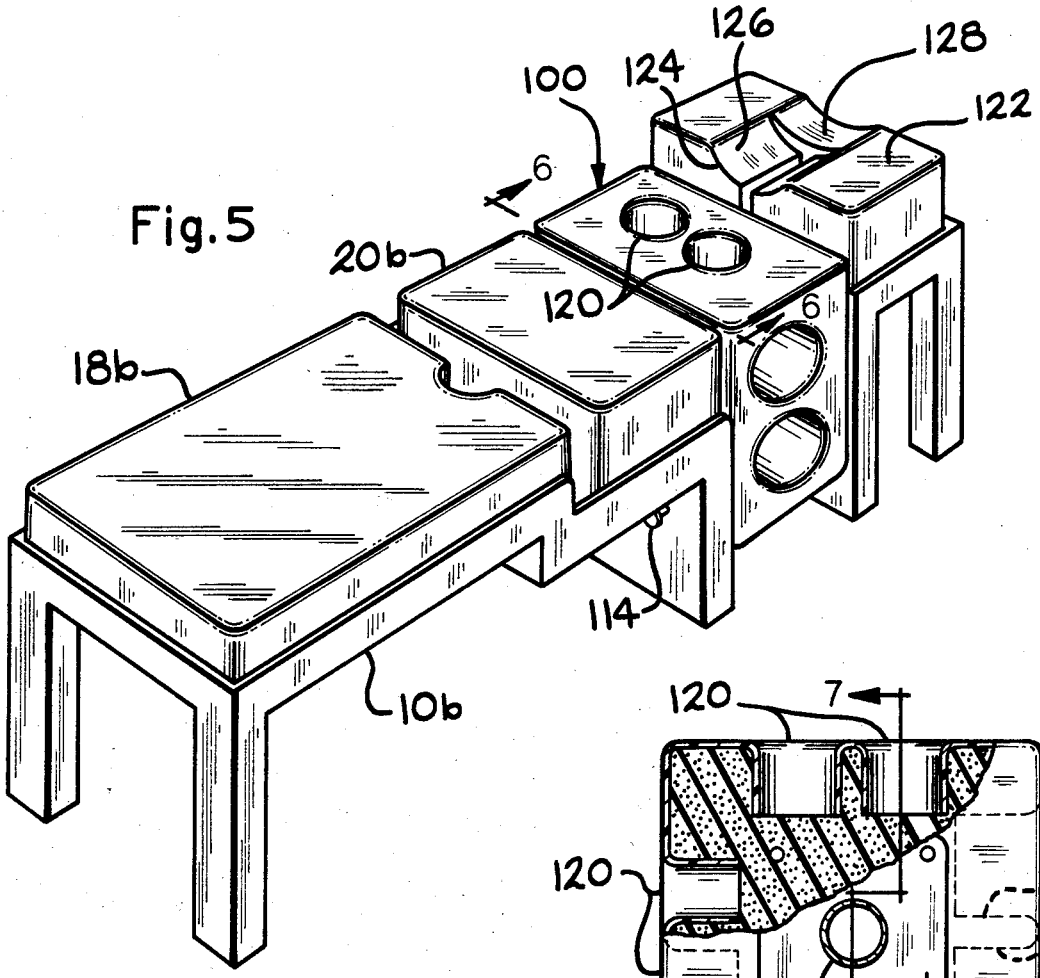
FIG. 5 is an oblique view of another embodiment of adjustment table.
Figure 6:
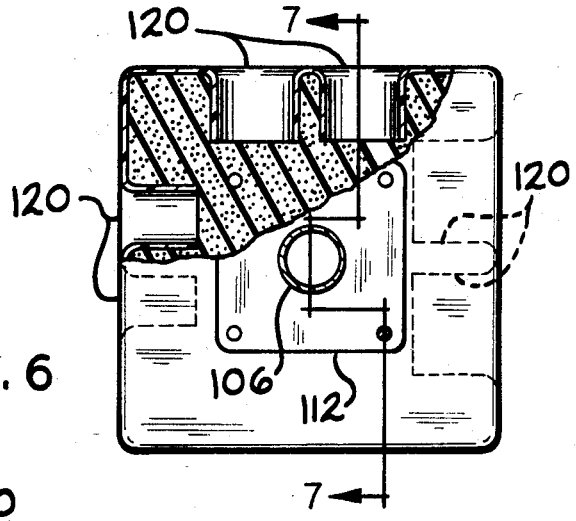
FIG. 6. is sectional view taken approximately on the line 6—6 of FIG. 5.
Figure 7:
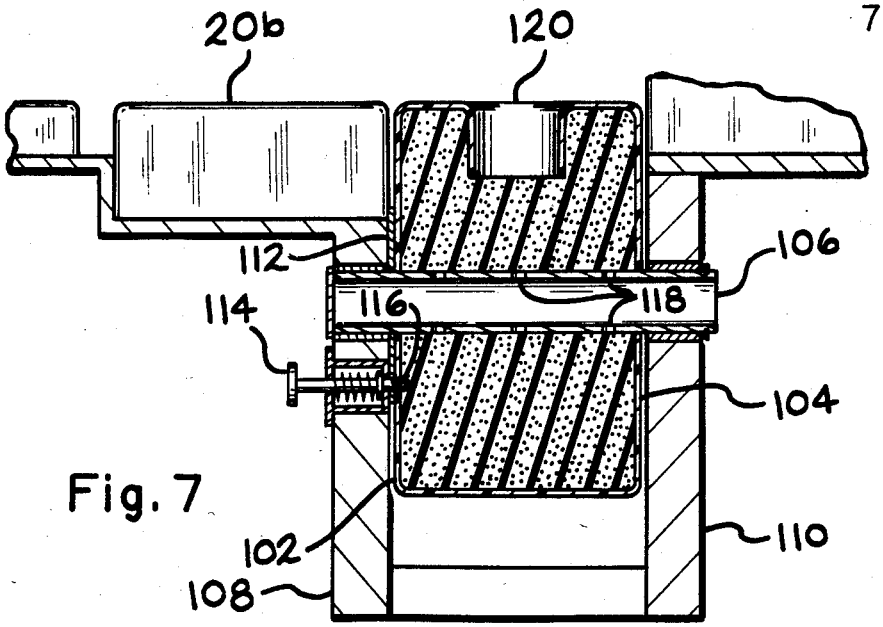
FIG. 7 is a sectional view taken approximately on the line 7—7 of FIG. 6.

The embodiment of adjusting table shown in FIGS. 5, 6 and 7 is similar to that of FIG. 1 but differs principally in that the breast cushion comprises a four sided turret, and in that the head cushion is specially designed.

Those portions of the embodiment shown in FIGS. 5, 6 and 7 which are similar to corresponding partions of FIG. 1 are designated by a like reference numeral excepting that a suffix "b" is affixed thereto.

The breast support surface of the embodiment being described is formed by the side surfaces of a turret 100. The turret 100 has opposing end surfaces 102 and 104 through which a tubular shaft 106 extends. The opposite ends of the tubular shaft 106 are journaled in support legs 108 and 110 for rotation which can bring any of the four sides of the turret flush with the stomach cushion **20*b*. The side surface 102 has a steel plate 112 welded to the tube 106 so that it rotates with the turret. A spring loaded detent 114 is mounted in the leg 108 with the end of the detent projecting into a suitable hole 116 in the plate 112 for preventing rotation of the turret. Four holes 116 are located in the plate 112, each positioned to hold a respective side surface of the turret in line with the stomach cushion 20*b***.

The four side surfaces of the turret 100 have a spring rate that is much less than the hip and leg cushion **18*b*, and can be moved downward by at least three inches. Any suitable means can be used to accomplish such movement and spring rate, and suitable coil springs will be one such expedient. In the embod1ment shown, however, the surfaces are formed by a deep open celled plastic foam body that is affixed to the shaft 106. The body is surfaced with an impervious plastic covering, and suitable openings 118 are provided through the sidewalls of the tube 106 so that air from the foam body can be displaced when a side surface of the body is compressed. Three of the side surfaces of the body each have a pair of breast receiving openings 120 therein that are located approximately three inches from the head end of the turret. The breast openings 120** in the three respective side surfaces are spaced about the same distance apart but are of different sizes to accomodate breasts of A and B, C and D, and E and larger cup sizes respectively. The fourth side is flat for male patients.

The head cushion 122 is slotted as at 124 to receive the nose and has tapered surfaces 126 for receiving the cheek bones. In addition it has a depression 128 curved to receive the forehead. The surfaces 126 and 128 are positioned at such elevation relative to the remainder of the body support surfaces to hold the neck level or slightly above the head end of the dorsal section of the spine.

It will be apparent that there has been provided a spinal adjustment table which not only accomodates breasts below the remainder of the body contact surfaces but better allows the dorsal section of the spine to sag and facilitate adjustment. In addition, an improved head rest supports the forehead, and side surfaces of the chin and cheeks to hold the head end of the dorsal section of the spine supported above the sagging chest support surface.

While the invention has been described in considerable detail, I do not wish to be limited to the particular embodiments shown and described; and it is my intention to cover hereby all adaptations, modifications and arrangements thereof which come within the practice of those skilled in the art to which the invention relates, and which fall within the purview of the following claims.

I claim

1. A spinal adjustment device extending longitudinally between head and foot ends, and comprising: an arrangement for supporting the body in a prone position, said arrangement having support surfaces for the head, chest-abdomen, and hip areas arranged sequentially lengthwise of said device, said head and hip support surfaces being generally firm and unyielding, and said chest-abdomen support surface having a spring rate that is considerably less than that of the generally unyielding head and hip support surfaces, said chest-abdomen support surface having breast receiving opening means therein spaced approximately three inches from the head end of said chest-abdomen support surface, and said chest-abdomen support surface being constructed and arranged so that downward force thereon sufficient ot move one vertebrae relative to another will move the chest-abdomen support surface below said head and hip support surfaces by at least approximately two inches, and whereby downward force on a body lying face down on said surfaces with its head and hips on said head and hip support surfaces respectively will sag the dorsal spinal region concavely without putting appreciable pressure on the breasts.

2. The spinal adjustment table of claim 1 wherein said breast receiving opening means is spaced from head end of said chest-abdomen support surface by a distance corresponding approximately to that of the first through third ribs of the human body.

3. A spinal adjustment device having head and foot ends, and comprising: an arrangement for supporting the human body in a prone position, said arrangement having upper and lower human body support surfaces with an intermediate human body support section in between, said intermediate body support surface being one side surface of a geometric body having at least one other side surface which can be moved into a human body support position, said one side surface having a pair of breast receiving openings therein of one size, and said other side surface having a pair of breast receiving openings of a size different from those in said one side surface, said openings being spaced approximately 3 inches from the upper ind of their intermediate human body support surface, and said grometric body providing a spring rate to its human body support surfaces that is sufficiently less than that of said upper and lower human body support surfaces so that downward force thereon sufficient to move one vertebrae relative to another will move the intermediate body support surfaces below said upper and lower support surfaces by at least approximately two inches, and whereby downward force on a body lying face down on said surfaces with its head and hips on said upper and lower body support surfaces respectively will sag the dorsal spinal region concavely without putting appreciable pressure on the breasts.

4. The spinal adjustment device of claim 3 wherein said geometric body having at least one side surface which can be moved into a human body support position is a cushion having a pair of conically shaped openings extending therethrough, said cushion being reversible to provide a pair of human body support surfaces having different size breast receiving openings therein.

5. The spinal adjustment device of claim 3 wherein said geometric body is an indexible geometric body pivoted about a longitudinal axis, and said side surfaces are indexed into the human body support position by rotation about said longitudinal axis.

6. The spinal adjustment device of claim 5 wherein said indexible geometric body is a four sided body with said four sides generally equally spaced from said axis of rotation.

7. A spine adjusting table comprising: a table for supporting the human body in a prone position, said table having support surfaces for the head, upper chest area above the breasts, lower chest and abdominal area below the breasts, and pelvic and upper lig areas, said surfaces generally lying in a plane, said support surfaces for said upper and lower chest areas being provided by a resilient cushion, and said cushion having a pair of breast receiving depressions in its human body support surface, said depressions being spaced approximately 3 inches from the upper edge of said cushion to support the first, second and third ribs of the human body, and said cushion having a spring rate that is sufficiently less than that of said head, and pelvic and leg areas of said table so that downward force on a vertebrae over said chest area will move said support surface of said cushion by at least approximately two inches below the surface of said head and pelvic areas and whereby downward pressure on the vertebrae connected to the fourth, fifth and sixth ribs of a human body lying face down on said surfaces will sag the dorsal spinal region concavely sufficiently to move one vertebrae relative to another without putting appreciable pressure on the breasts.

8. The adjusting table of claim 7 wherein said resilient cushion has a flexible band extending across the cushion and around said depressions to transfer tensile forces around said depressions.

9. The spinal adjustment table of claim 1 wherein: said breast receiving opening means is a pair of openings spaced apart sufficiently that said chest support surface abutts the chest between the breasts.

* * * * *